US007101174B2

(12) United States Patent
Tomiura et al.

(10) Patent No.: US 7,101,174 B2
(45) Date of Patent: Sep. 5, 2006

(54) BURNER

(75) Inventors: Hideyuki Tomiura, Nagoya (JP); Masanobu Inomata, Nagoya (JP); Kazuyuki Akagi, Nagoya (JP)

(73) Assignee: Rinnai Corporation, Nagoya (JP)

( * ) Notice: Subject to any disclaimer, the term of this patent is extended or adjusted under 35 U.S.C. 154(b) by 130 days.

(21) Appl. No.: 10/864,580

(22) Filed: Jun. 10, 2004

(65) Prior Publication Data

US 2004/0224274 A1 Nov. 11, 2004

(51) Int. Cl.
*F23D 14/58* (2006.01)
*F23D 14/62* (2006.01)

(52) U.S. Cl. ..... 431/354; 431/349

(58) Field of Classification Search ..... 431/354, 431/349, 168, 172, 278, 286; 126/39 E, 126/39 R; 239/555, 558
See application file for complete search history.

(56) References Cited

U.S. PATENT DOCUMENTS

2003/0190573 A1* 10/2003 Keem ..... 431/354

FOREIGN PATENT DOCUMENTS

JP 2-133515 U 11/1990
JP 3-14531 U 2/1991
JP 4-353308 A 12/1992
JP 9-4853 A 1/1997

* cited by examiner

*Primary Examiner*—Alfred Basichas
(74) *Attorney, Agent, or Firm*—Birch, Stewart, Kolasch & Birch, LLP

(57) ABSTRACT

The present invention provides a burner capable of recovering more reliably a flame going out at one flame port via the transfer of flames from other flame ports when the burner is turned down. The burner according to the present invention is formed of two metal plates 10, 20 having substantially wave-shaped ends and superposed with the wave phases shifted. The burner comprises plural flame ports 12, 22 vertically alternately disposed along the ends of the metal plates 10, 20, and plural gas channels 14, 24 for supplying gas to the flame ports 12, 22. The burner further has a first deformed portion 16 where one metal plate 10 is deformed toward the other metal plate 20 at the flame port portions of one of the upper and lower flame ports 12, 22. In the first deformed portion 16, the vertical distance between the upper flame port center 12*x* and the adjacent lower flame port center 22*x* is shorter than the vertical distance between the centers of the correspondingly adjacent upper gas channel 14 and lower gas channel 24.

16 Claims, 5 Drawing Sheets

PRIOR ART

BURNER

BACKGROUND OF THE INVENTION

1. Field of the Invention

The present invention relates to a burner having two metal plates with substantially wave-shaped ends which are superposed with their wave phases shifted, thereby forming a plurality of flame ports vertically alternately arranged along the ends, and a plurality of gas channels for supplying gas to the flame ports.

2. Description of the Related Art

Heretofore, a burner illustrated in FIG. 6 is known, having two metal plates 510 and 520 with substantially wave-shaped ends which are superposed with their wave phases shifted, thereby forming a plurality of flame ports 512, 522 vertically alternately arranged along the ends, and linear gas channels 514, 524 having one end starting at the flame ports 512, 522.

The gas supplied via the gas channels 514, 524 to the flame ports 512, 522 is burned, generating flames at the flame ports 512 and 522, and the burner is thereby burned. However, when the gas supply to the burner is reduced drastically in order to turn the burner down from high power to low power, or when a disturbance of air flow or the like occurs around the flame ports 512 and 522, the flames may go out at a portion of the flame ports 512, 522. In such case, the recovery of the flames which have gone out at flame ports 512, 522 is provided by the transfer of flames from the nearest flame port 512, 522 maintaining its flame.

SUMMARY OF THE INVENTION

However, the present inventors have discovered that the burner illustrated in FIG. 6 leaves room for improvement from the viewpoint of the recovery of flames of the flame ports 512, 522 by the transfer of flames when the burner is turned down and flames go out, the details of which will be described later.

Therefore, the object of the present invention is to provide a burner capable of more reliably recovering the flame having gone out at one flame port when the burner is turned down via the transfer of flames from other ports.

In order to realize the above-mentioned object, the burner according to the present invention comprises a first deformed portion where one of the metal plates is deformed toward the other metal plate at the flame port portion of one of the upper and lower flame ports, so that the vertical distance between an upper flame port center and an adjacent lower flame port center is shorter than the vertical distance between the correspondingly adjacent upper gas channel center and lower gas channel center.

According to the present invention, since one of the metal plates is deformed toward the other metal plate at the flame port portion of one metal plate, the vertical distance between the adjacent upper and lower flame port centers are made shorter compared to the case where the shapes of the upper and lower flame ports are the same as the cross-sectional shapes of the upper and lower gas channels. Therefore, according to the present invention, even when the flame of one flame port goes out when the burner is turned down, the flame of the one flame port can be reliably recovered by the transfer of flames from the other flame port maintaining the flame via the deformed flame port.

Further, the burner according to the present invention further comprises a second deformed portion where one of the upper and lower metal plates coming into contact with each other at areas where the adjacent upper and lower flame ports are divided is deformed away from the other metal plate so that the upper and lower flame ports are communicated.

According to the present invention, when the burner is turned down and the flame of one flame port goes out, the transfer of flames from the adjacent flame ports will not be obstructed by the contact areas of the upper and lower metal plates. Therefore, the transfer of flames from adjacent flame ports is promoted, and the flame of said one flame port can be recovered more reliably.

Moreover, the burner according to the present invention is characterized in that the flame ports have opening areas of different sizes.

According to the present invention, since the flame ports have different opening area sizes, the flames of the flame ports having smaller opening areas may go out when the burner is turned down, but there is higher possibility of at least a portion of the flames of the flame ports having larger opening areas to be maintained. Therefore, the present invention prevents the occurrence of a situation where the flames of all the flame ports go out when the burner is turned down and the recovery of combustion of the burner can no longer be expected via transfer of flames.

Furthermore, the burner according to the present invention characterizes in that the opening area of the lower flame ports is larger than the opening area of the upper flame ports, and the burner has a first deformed portion where the upper metal plate is deformed toward the lower metal plate at the upper flame port portion, so that the vertical distance between an upper flame port center and an adjacent lower flame port center is shorter than the vertical distance between the correspondingly adjacent upper gas channel center and lower gas channel center.

According to the present invention, since the opening area of the lower flame ports is greater than the opening area of the upper flame ports, it is possible to prevent the flames of upper and lower flame ports from going out together when the burner is turned down. If even a portion of the flames of the lower flame ports remains when all the flames of the upper flame ports go out, the flame from the lower flame port still maintaining the flame is transferred to the adjacent upper flame port, then from this upper flame port to the lower flame port adjacent thereto and so on in a sequential manner, so that all the flames on the lower flame ports can be recovered reliably.

Furthermore, the burner according to the present invention characterizes in that both the upper and lower gas channels are slanted with the flame ports disposed upward.

According to the present invention, the transfer of flames of the lower flame port via the upper flame port to other flame ports is promoted by drawing the flame of the lower flame port closer to the upper flame port, using the property that flame generated from the flame port has its tip portion slanted upward.

DETAILED DESCRIPTION OF THE PREFERRED EMBODIMENTS

Now, the preferred embodiments of the burner according to the present invention will be described with reference to the drawings.

First, the burner according to a first preferred embodiment will be described with reference to FIGS. 1 through 5.

Figure 1:
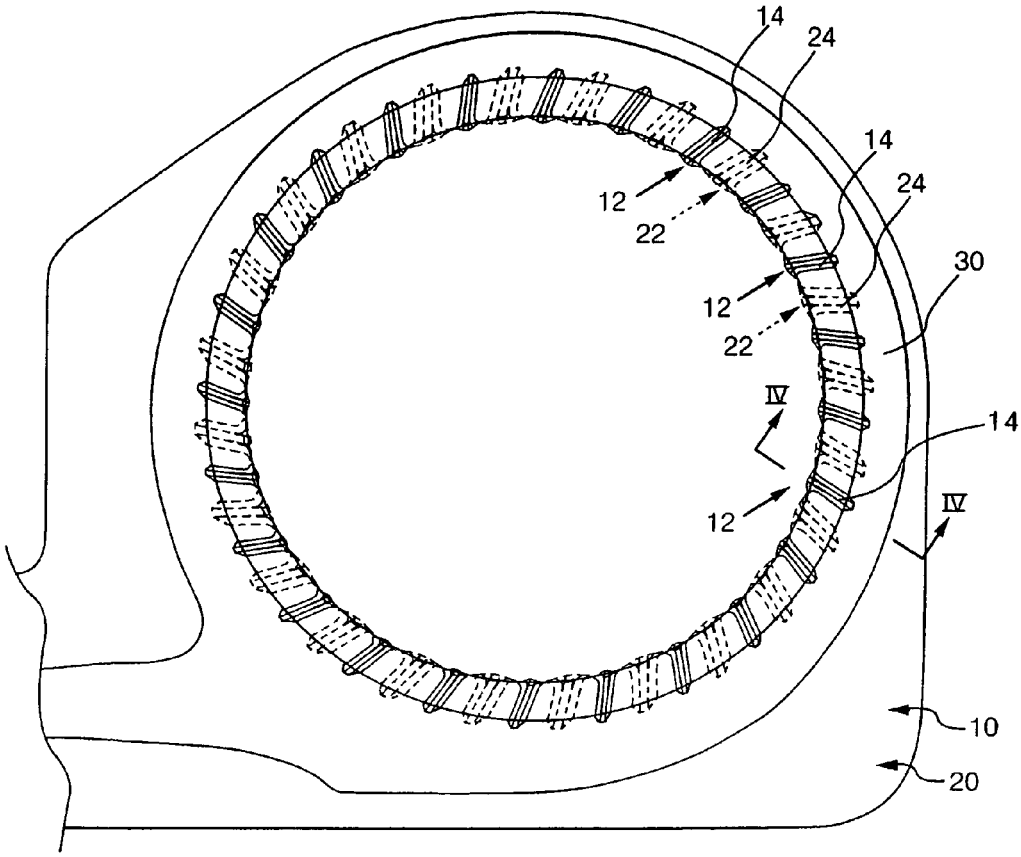
FIG. 1 is a top view of a burner according to a first embodiment of the present invention.
Figure 2:
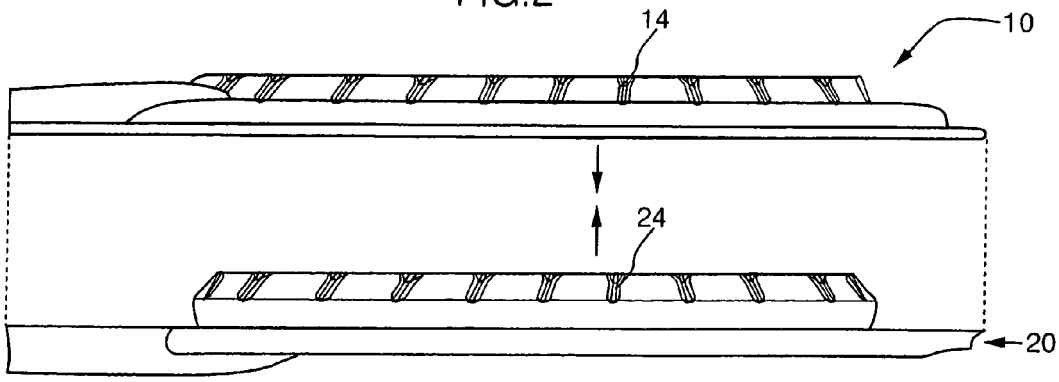
FIG. 2 is a side view of upper and lower metal plates forming the burner according to the first embodiment of the present invention.

The present burner is formed by superposing two metal plates 10 and 20 having a round opening (FIG. 1), and crimping the plates together at the periphery (FIG. 2). The periphery portion of the opening of each metal plate 10 and 20 is formed into a substantially truncated cone shape expanding downwardly (FIG. 2), and an annular mixture pipe 30 is formed further outward.

Figure 3A:
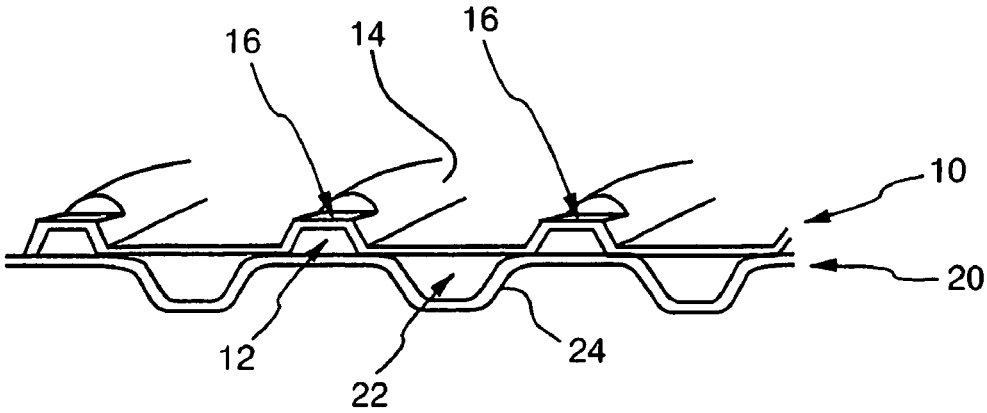
FIG. 3 is an explanatory view showing the structure of the relevant portion of the burners according to the first and second embodiments of the present invention.
Figure 3B:
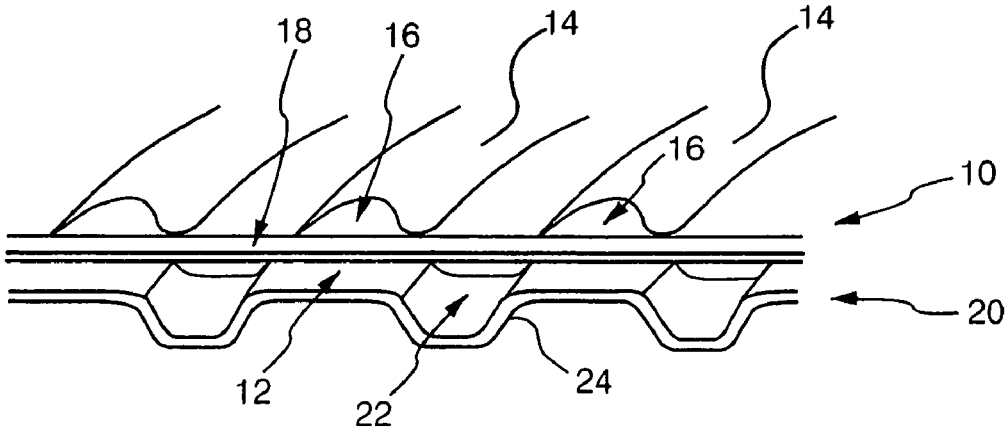

Further, the periphery portion of the opening of each metal plate 10 and 20 is formed into a substantial waveform having equal wave periods disposed along the circumferential direction, and the metal plates 10 and 20 are superposed so that their wave phases are shifted by approximately p/2 (FIG. 3). Thereby, a plurality of upper flame ports 12 and a plurality of lower flame ports 22 vertically alternately disposed along the circumferential direction of the opening (FIG. 1) are formed (FIG. 3(*a*)). Further, linear upper gas channels 14 and lower gas channels 24 are formed, each having one end starting at the upper flame port 12 or lower flame port 22 and extending diagonally downward along the truncated cone shaped periphery portion of the opening to reach the annular mixture pipe 30 (refer to FIG. 4). The gas channels 14 and 24 are separated by the upper and lower metal plates 10 and 20 coming into contact with each other at areas between the adjacent upper and lower gas channels 14 and 24.

The cross-sectional area of the lower gas channels 24 is greater than the cross-sectional area of the upper gas channels 14. Moreover, the upper metal plate 10 has a first deformed portion 16 (FIG. 3) formed to a portion of the upper flame ports 12. At the first deformed portion 16, the upper metal plate 10 is crimped and deformed toward the lower metal plate 20. Thereby, the vertical distance between the center 12*x* of the upper flame port 12 and the center 22*x* of the lower flame port 22 adjacent thereto becomes shorter than the vertical distance between the center 14*x* of the correspondingly adjacent upper gas channel 14 and the center 24*x* of the lower gas channel 24.

The burner is equipped with substantially annular upper and lower flow regulating plates (not shown) that are concentrically disposed above and below the opening for regulating the flow of secondary air supplied to the flame ports.

The functions of the burner according to the first embodiment will now be described.

Figure 5A:
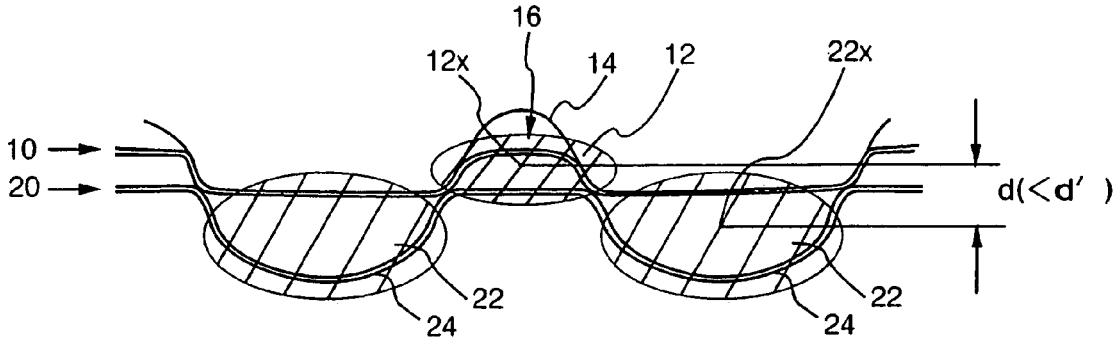
FIG. 5 is an explanatory view comparing the functions of the burners according to the first and second embodiments of the present invention and the prior art burner.
Figure 5B:
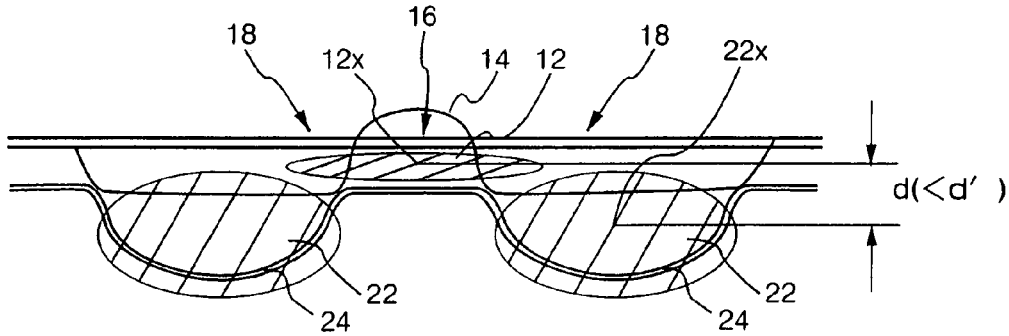
Figure 5C:
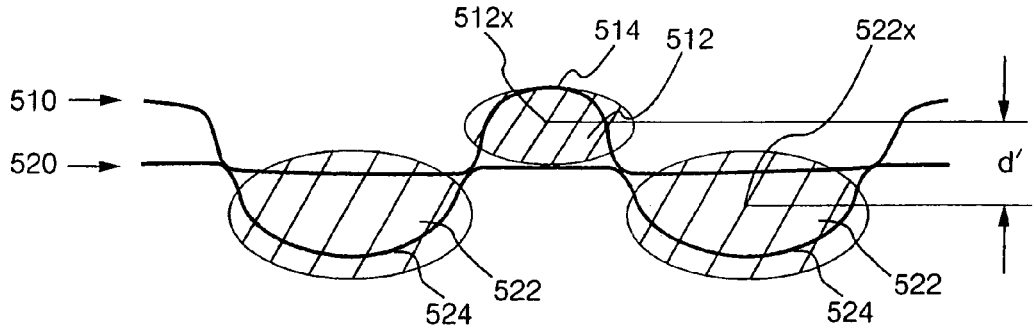
Figure 6:
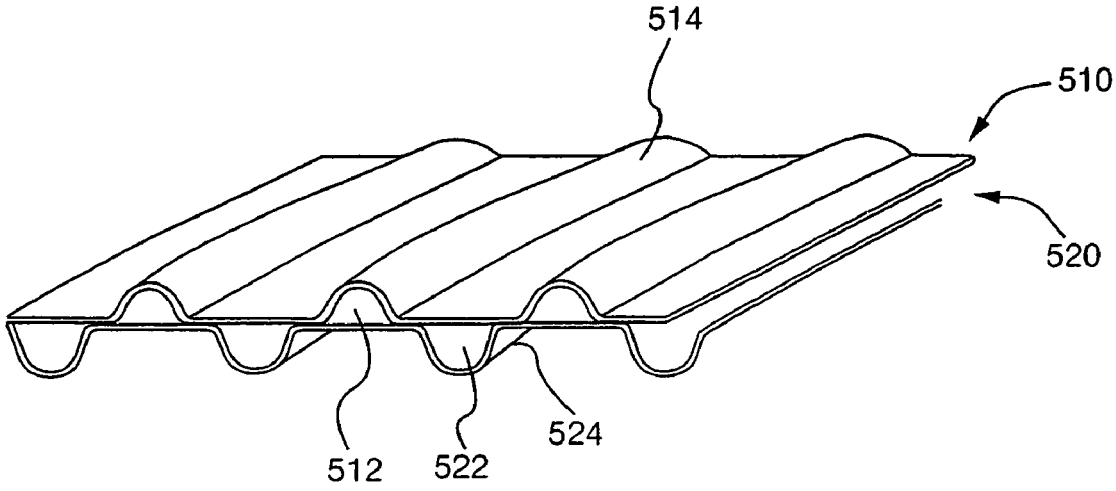
FIG. 6 is an explanatory view of the prior art burner.

FIG. 5(*a*) and FIG. 5(*c*) respectively illustrate by shaded sections the range of the flames near the flame ports when the burner of the first embodiment and the burner of the prior art (refer to FIG. 5) are turned down. According to the prior art burner, the vertical distance d' between the center 512*x* of the upper flame port 512 and the center 522*x* of the lower flame port 522 is equal to the vertical distance between the center of the upper gas channel 514 and the center of the lower gas channel 524. On the contrary, the burner according to the first embodiment has a first deformed portion 16 on the upper metal plate 10, by which the apex of the upper flame port 12 is lowered for a predetermined distance (=d'−d (>0)), and the vertical distance d between the adjacent upper flame port center 12*x* and the lower flame port center 22*x* is made shorter than the vertical distance (=d') between the center of the correspondingly adjacent upper gas channel 14 and the center of the lower gas channel 24. Therefore, compared to the prior art burner (refer to FIG. 5(*c*)), the range of the flame near the upper flame port 12 is closer to the lower flame port 22 when the burner is turned down (refer to FIG. 5(*a*)). Thus, the flame going out at one flame port 12 or 22 when the burner is turned down can be recovered reliably through transfer of flames via the upper flame port 12 from the other flame ports 12 and 22 maintaining their flames.

Since the opening area of the lower flame port 22 is greater than the opening area of the upper flame port 12, it is possible to prevent the flames of both the upper flame port 12 and the lower flame port 22 from going out together when the burner is turned down. If even a portion of the flames of the lower flame ports 22 remains when all the flames of the upper flame ports 12 have gone out, the flame from the lower flame port 22 still maintaining the flame is transferred to the adjacent upper flame port 12, then from this upper flame port 12 to the lower flame port 22 adjacent thereto and so on in a sequential manner, so that all the flames on the lower flame ports 22 can be recovered reliably.

Figure 4:
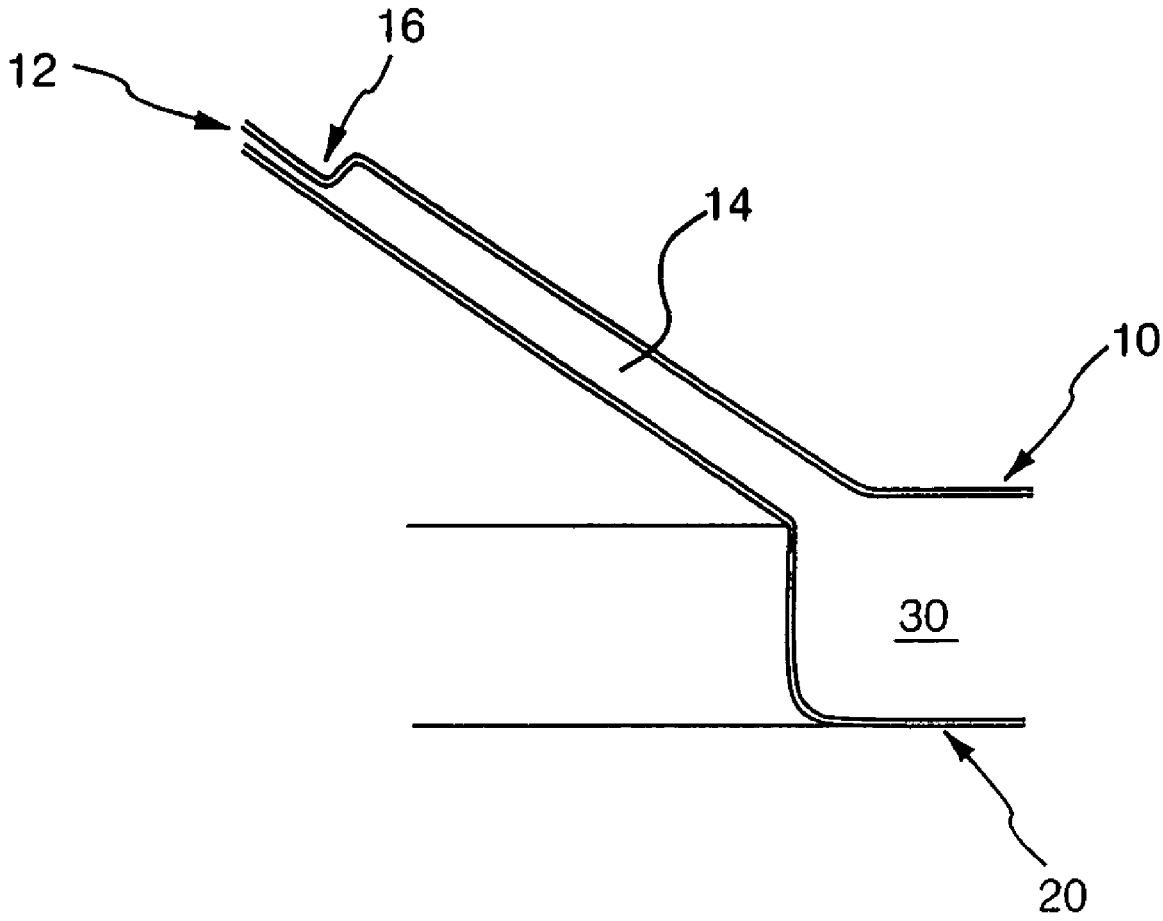
FIG. 4 is a vertical cross-sectional view taken at line IV–IV of FIG. 1.

Both the upper and lower gas channels 14 and 24 are slanted with the flame ports 12, 22 disposed upward (refer to FIG. 4). Therefore, using the property that the tip of the flames coming out from the flame ports 12 and 22 is slanted upwards, the flames of the flame ports 22 are drawn close to the upper flame port 12, promoting the transfer of flames from the lower flame port 22 via the upper flame port 12 to other flame ports 12 and 22.

Next, the burner according to the second preferred embodiment will be described with reference to FIGS. 3 and 5.

The present burner has a similar construction as the burner of the first embodiment except that a second deformed portion 18 is formed to the upper metal plate 10, so the components are denoted by the same reference numbers and detailed descriptions thereof are omitted. In the second deformed portion 18, as illustrated in FIG. 3(*b*) and FIG. 5(*b*), the upper metal plate 10 is deformed toward the direction away from the lower metal plate 20 at the portions where the adjacent upper and lower flame ports 12 and 22 are divided. Thereby, the upper metal plate 10 that had been in contact with the lower metal plate 20 is separated from the lower metal plate 20, and the upper and lower flame ports 12 and 22 are communicated. The heights of the first deformed portion 16 and the second deformed portion 18 are the same, so the end of the upper metal plate 10 extends at the same height along the whole periphery.

According to the burner of the second embodiment, since the structure defining the sides of the upper flame ports 12 is removed by the second deformed portion 18, the range of the flame near the upper flame port 12 when the burner is turned down is widened in the lateral direction (refer to the shaded portions of FIG. 5(*b*)). Therefore, when the burner is turned down and the flame of one port 12 or 22 goes out, the transfer of flames from the adjacent flame ports 12 and 22 is not obstructed at the area of contact of the upper and lower metal plates 10 and 20. Thus, the transfer of flames between the adjacent flame ports 12 and 22 are promoted, and the flame of said one flame port 12 or 22 can be recovered more reliably.

According to the first and second embodiments, the upper metal plate 10 is deformed with respect to all the upper flame ports 12 so that the vertical distance between the center 12*x* thereof and the lower flame port center 22*x* is shortened, but in another embodiment, it is possible to deform the upper metal plate 10 with respect to only a portion of the upper flame ports 12 so that the vertical distance between the center 12*x* thereof and the lower flame port center 22*x* is shortened. Furthermore, it is possible to deform the lower metal plate 20 with respect to all or a portion of the lower flame ports 22 so that the vertical distance between the center 22*x* thereof and the upper flame port center 12*x* is shortened.

According to the first and second embodiments, the opening areas of all the lower flame ports 22 are formed larger than the opening areas of the upper flame ports 12, but in another embodiment, the opening areas of only a portion of the lower flame ports 22 can be formed larger than the opening areas of the upper flame ports 12. Further, it is possible to form all or a portion of the opening areas of the upper flame ports 12 to be larger than the opening areas of the lower flame ports 22. Furthermore, the opening areas may differ among the upper flame ports 12, or the opening areas may differ among the lower flame ports 22.

According to the second embodiment, the upper metal plate 10 is deformed to separate the upper and lower metal plates 10 and 20 which had been in contact with one another dividing the upper and lower flame ports 12 and 22, but according to another embodiment, the lower metal plate 20 can be deformed to separate the upper and lower metal plates 10 and 20 which had been in contact with one another dividing the upper and lower flame ports 12 and 22.

Further, the distance of separation of the metal plates 10 and 20 at the second deformed portion 18 can be changed appropriately within the range not exceeding the height of the upper flame ports 12 at the first deformed portion 16.

What is claimed is:

1. A burner comprising:

upper and lower metal plates, having substantially wave-shaped ends and superposed with the wave phases shifted, forming a plurality of flame ports vertically alternately disposed along the ends, and a plurality of gas channels for supplying gas to the flame ports; and a first deformed portion where one of the metal plates is deformed toward the other metal plate at the flame port portion of one of the upper and lower flame ports, so that a vertical distance between an upper flame port center and an adjacent lower flame port center is shorter than a vertical distance between the correspondingly adjacent upper gas channel center and lower gas channel center.

2. The burner according to claim 1, further comprising a second deformed portion where one of the upper and lower metal plates coming into contact with each other at areas where the adjacent upper and lower flame ports are divided is deformed away from the other metal plate so that the upper and lower flame ports are communicated.

3. The burner according to claim 1, wherein the flame ports have opening areas of different sizes.

4. The burner according to claim 2, wherein the flame ports have opening areas of different sizes.

5. The burner according to claim 1, wherein an opening area of the lower flame ports is larger than an opening area of the upper flame ports, and the burner has a first deformed portion where the upper metal plate is deformed toward the lower metal plate at the upper flame port portion, so that the vertical distance between an upper flame port center and an adjacent lower flame port center is shorter than the vertical distance between the correspondingly adjacent upper gas channel center and lower gas channel center.

6. The burner according to claim 1, wherein both the upper and lower gas channels are slanted with the flame ports disposed upward.

7. The burner according to claim 2, wherein both the upper and lower gas channels are slanted with the flame ports disposed upward.

8. The burner according to claim 3, wherein both the upper and lower gas channels are slanted with the flame ports disposed upward.

9. The burner according to claim 4, wherein both the upper and lower gas channels are slanted with the flame ports disposed upward.

10. The burner according to claim 5, wherein both the upper and lower gas channels are slanted with the flame ports disposed upward.

11. A burner comprising:

a first metal plate having a plurality of first gas channels for supplying gas to respective first gas ports at ends of the first gas channels; and a second metal plate having a plurality of second gas channels for supplying gas to respective second gas ports at ends of the second gas channels, said second metal plate being joined with the fist metal plate such that the fist and second gas ports are alternately arranged at ends of the first and second metal plates, wherein a vertical distance between a first flame port center and an adjacent second flame port center of the first and second flame ports is shorter than a vertical distance between a correspondingly adjacent first gas channel center and second gas channel center.

12. The burner according to claim 11, wherein at least one of the first and second metal plates have deformed portion at portions between adjacent gas ports such that the first and second flame ports communicate with each other.

13. The burner according to claim 11, wherein the first and second flame ports have opening areas of different sizes.

14. The burner according to claim 12, wherein the first and second flame ports have opening areas of different sizes.

15. The burner according to claim 11, wherein both the upper and lower gas channels are slanted with the flame ports disposed upward.

16. The burner according to claim 11, wherein the first and second gas channels and gas ports comprise a wave shape.

* * * * *